US011364599B2

(12) United States Patent
Chang

(10) Patent No.: US 11,364,599 B2
(45) Date of Patent: Jun. 21, 2022

(54) TWO-WAY RATCHET WRENCH

(71) Applicant: Chih-Min Chang, Xiushui Township (TW)

(72) Inventor: Chih-Min Chang, Xiushui Township (TW)

( * ) Notice: Subject to any disclaimer, the term of this patent is extended or adjusted under 35 U.S.C. 154(b) by 229 days.

(21) Appl. No.: 16/558,998

(22) Filed: Sep. 3, 2019

(65) Prior Publication Data

US 2020/0070319 A1 Mar. 5, 2020

(30) Foreign Application Priority Data

Sep. 4, 2018 (TW) ..... 107131006

(51) Int. Cl.
*B25B 13/46* (2006.01)

(52) U.S. Cl.
CPC ..... *B25B 13/463* (2013.01)

(58) Field of Classification Search
CPC ..... B25B 13/463
USPC ..... 81/60–63.2
See application file for complete search history.

(56) References Cited

U.S. PATENT DOCUMENTS 6,513,409 B1 * 2/2003 Lee ..... B25B 13/463 81/63
6,520,051 B1 * 2/2003 Hu ..... B25B 13/463 81/60
6,644,148 B2 * 11/2003 Hu ..... B25B 13/461 81/63
6,904,832 B1 * 6/2005 Chen ..... B25B 13/463 81/63
6,925,913 B2 * 8/2005 Chen ..... B25B 13/463 192/43.2
7,121,170 B2 * 10/2006 Shen ..... B25B 13/463 81/63.2
7,444,904 B2 * 11/2008 Huang ..... B25B 13/463 192/43.2

* cited by examiner

*Primary Examiner* — Hadi Shakeri
(74) *Attorney, Agent, or Firm* — Muncy, Geissler, Olds & Lowe, P.C.

(57) ABSTRACT

A two-way ratchet wrench includes a wrench body having a ratchet groove located in a head at one end thereof, an accommodation chamber in communication with the ratchet groove, an accommodation hole above the accommodation chamber, a ratchet wheel mounted in the ratchet groove, a ratchet block mounted in the accommodation chamber and meshed with the ratchet wheel, a dial block rotatably mounted in the accommodation hole and operable to move the ratchet block between a first position and a second position, and a positioning device mounted in the accommodation chamber such that the ratchet block is held in the first position when the positioning device is abutted against the first recess of the ratchet block, or the second position when the positioning device is abutted against the second recess of the ratchet block.

4 Claims, 5 Drawing Sheets

TWO-WAY RATCHET WRENCH

BACKGROUND OF THE INVENTION

1. Field of the Invention

The present invention relates to wrench technology, and more particularly to a two-way ratchet wrench that is easy to assemble and that operates smoothly.

2. Description of the Related Art

The traditional two-way ratchet wrench mainly switches the direction of rotation of the ratchet wheel by changing the meshing position between ratchet wheel and the ratchet block. The ratchet block usually uses a dial block to create a structural linkage relationship with the ratchet wheel. As long as the dial block is operated, the ratchet block can be driven to its meshing position, achieving the steering switching function of the ratchet wheel.

Relevant designs of the wrench are found to have the same problem, for example, owing that the volume of the dial block is subject to the overall structure, the dial block is difficult to assemble, the reliability is poor, and the operation is not smooth, so that it may disturb the user and cause inconvenience when operating the wrench.

SUMMARY OF THE INVENTION

The present invention has been accomplished under the circumstances in view. It is the main object of the present invention to provide a two-way ratchet wrench, which is reliable and easy to assemble and facilitates smooth operation.

To achieve this object of the present invention, a two-way ratchet wrench comprises a wrench body, a ratchet wheel, a check device set, and a positioning device. The wrench body comprises a head at one end thereof and a open end portion at an opposite end thereof. The head of the wrench body comprises a ratchet groove, an accommodation chamber radially disposed in communication with the ratchet groove, and an accommodation hole adjacent to the ratchet groove and disposed above the accommodation chamber. The ratchet wheel is rotatably mounted in the ratchet groove of the wrench body for the engagement of a workpiece (such as screw or screw nut), comprising a toothed portion around a periphery thereof. The check device set comprises a ratchet block and a dial block. The ratchet block is mounted in the accommodation chamber of the wrench body, comprising a ratchet portion facing toward the ratchet wheel and a first recess and a second recess located on one side thereof opposite to the ratchet wheel. The ratchet portion of the ratchet block is meshed with the toothed portion of the ratchet wheel to limit the rotation of the ratchet wheel in one single direction. The dial block is rotatably mounted in the accommodation hole of the wrench body and connected with the ratchet block and operable to move the ratchet block between a first position and a second position. The positioning device is mounted in the accommodation chamber of the wrench body. When the ratchet block is disposed in the first position, the positioning device is abutted against the first recess of the ratchet block, enabling the ratchet wheel to be rotated in one of the clockwise and counter-clockwise directions. When the ratchet block is disposed in the second position, the positioning device is abutted against the second recess of the ratchet block, enabling the ratchet wheel to be rotated in the other of the clockwise and counter-clockwise directions.

Preferably, the dial block comprises a dial block body and a tab connected with the dial block. The dial block body comprises a bottom groove located in a bottom wall thereof. The check device set further comprises an elastic member mounted in the bottom groove and abutted between the dial block body of the dial block and the head of the wrench body to provide a spring force to the dial block, enhancing the operational stability of the dial block.

Preferably, the wrench body further comprises a second internal annular indentation located in a wall of the accommodation hole. The dial block further comprises a second external annular indentation located on an outer perimeter of the dial block body. The check device set further comprises a second C-shaped retainer mounted in between the second internal annular indentation and the second external annular indentation to secure the dial block to the accommodation hole. Preferably, the dial block further comprises a plug hole located in a wall of the second external annular indentation. The second C-shaped retainer comprises a protruding portion protruded from an inner perimeter thereof and plugged into the plug hole. By means of plugging the protruding portion into the plug hole, the second C-shaped retainer is secured in place. Therefore, the second C-shaped retainer is not easily dropped after having been installed in the second external annular indentation, increasing the convenience of assembly, Other advantages and features of the present invention will be fully understood by reference to the following specification in conjunction with the accompanying drawings, in which like reference signs denote like components of structure.

DETAILED DESCRIPTION OF THE INVENTION

Figure 1:
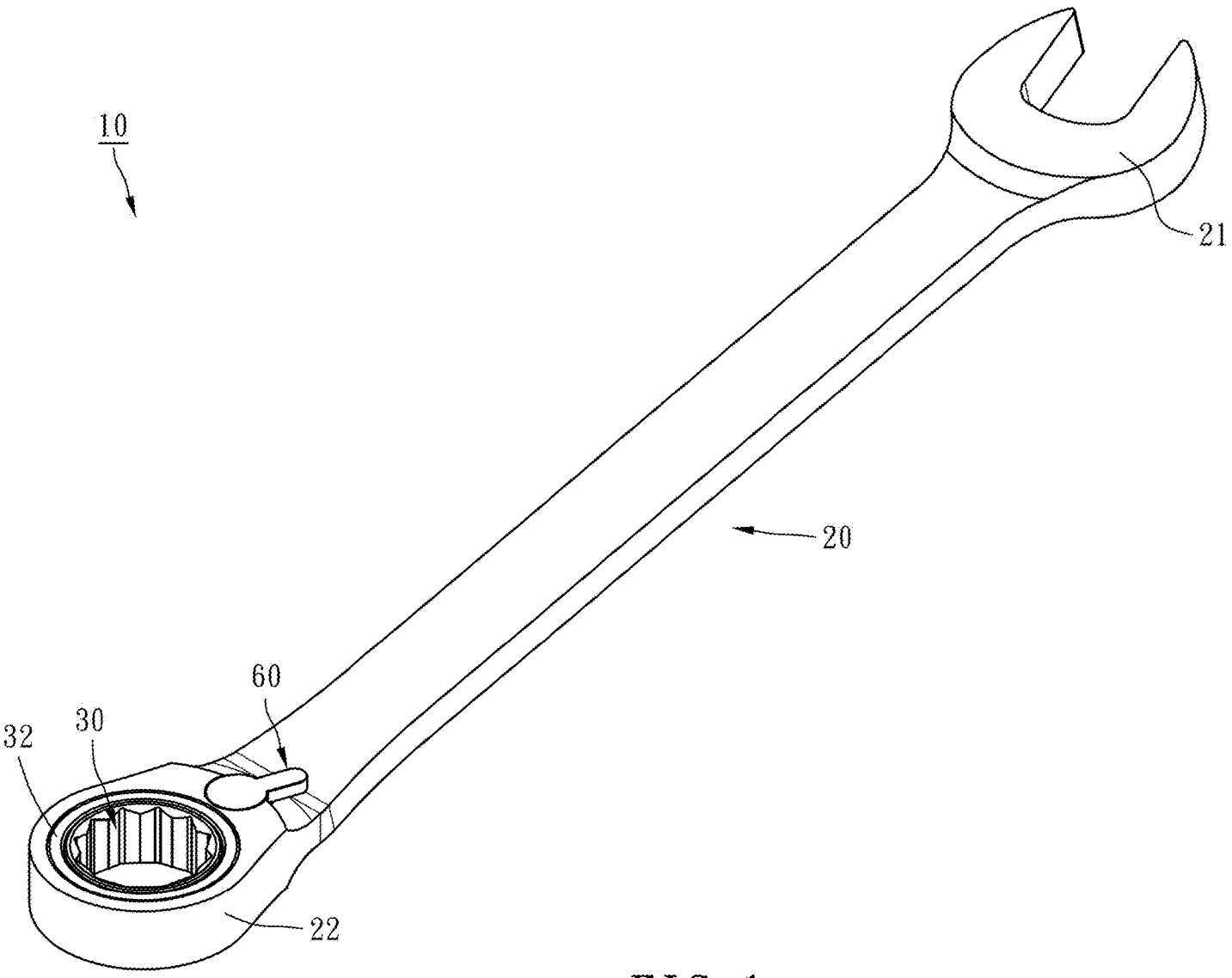
FIG. 1 is an oblique top elevational view of a two-way ratchet wrench in accordance with a first embodiment of the present invention.

Firstly, in the following embodiment and drawings, the same reference numerals are used to indicate similar or the same members or its structural features.

Figure 2:
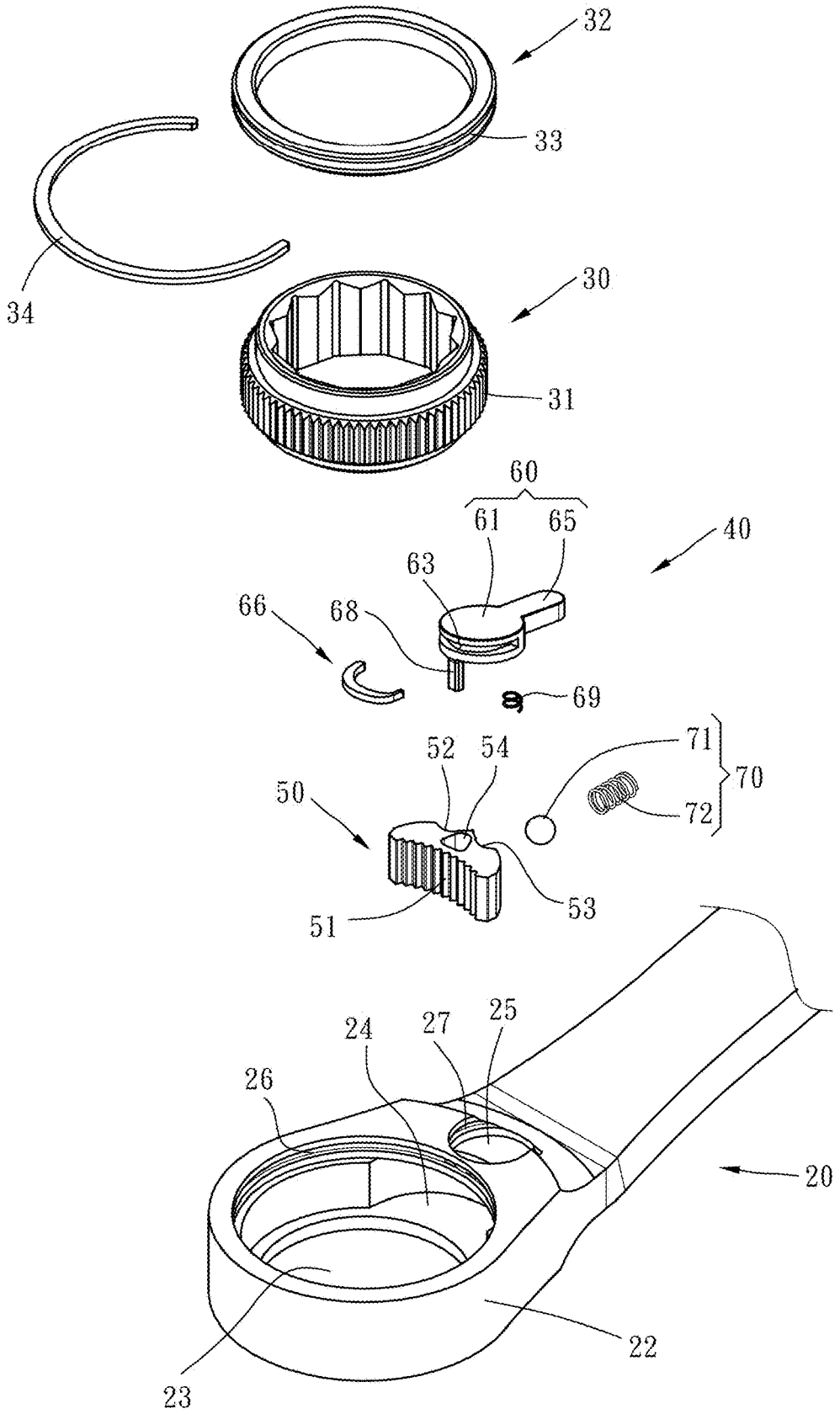
FIG. 2 is an exploded view of the two-way ratchet wrench in accordance with the first embodiment of the present invention.

Referring to FIGS. 1 and 2, a two-way ratchet wrench 10 in accordance with the present invention is shown. As illustrated, the two-way ratchet wrench 10 comprises a wrench body 20, a ratchet wheel 30, a check device set 40, and a positioning device 70.

The wrench body 20 comprises an open end portion 21 at one end thereof, and a head 22 at an opposite end thereof. The head 22 defines therein a ratchet groove 23, an accommodation chamber 24 radially disposed in communication with the ratchet groove 23, an accommodation hole 25 disposed adjacent to the ratchet groove 23 and disposed above the accommodation chamber 24, a first internal annular indentation 26 disposed on a wall of the ratchet groove 23, and a second internal annular indentation 27 disposed on a wall of the accommodation hole 25.

The ratchet wheel 30 is rotatably mounted in the ratchet groove 23 of the wrench body 20 for the engagement of a workpiece (such as screwhead or screw nut, not shown in the drawings), comprising a toothed portion 31 extending around a periphery of the ratchet wheel 30. Further, the ratchet wheel 30 is restrained by a cover member 32 and does not detach from the ratchet groove 23. The cover member 32 has a first external annular indentation 33 around a periphery of cover member 32. A first C-shaped retainer 34 is mounted between the first internal annular indentation 26 and the first external annular indentation 33 to secure the cover member 32 to the head 22 of the wrench body 20.

Figure 3:
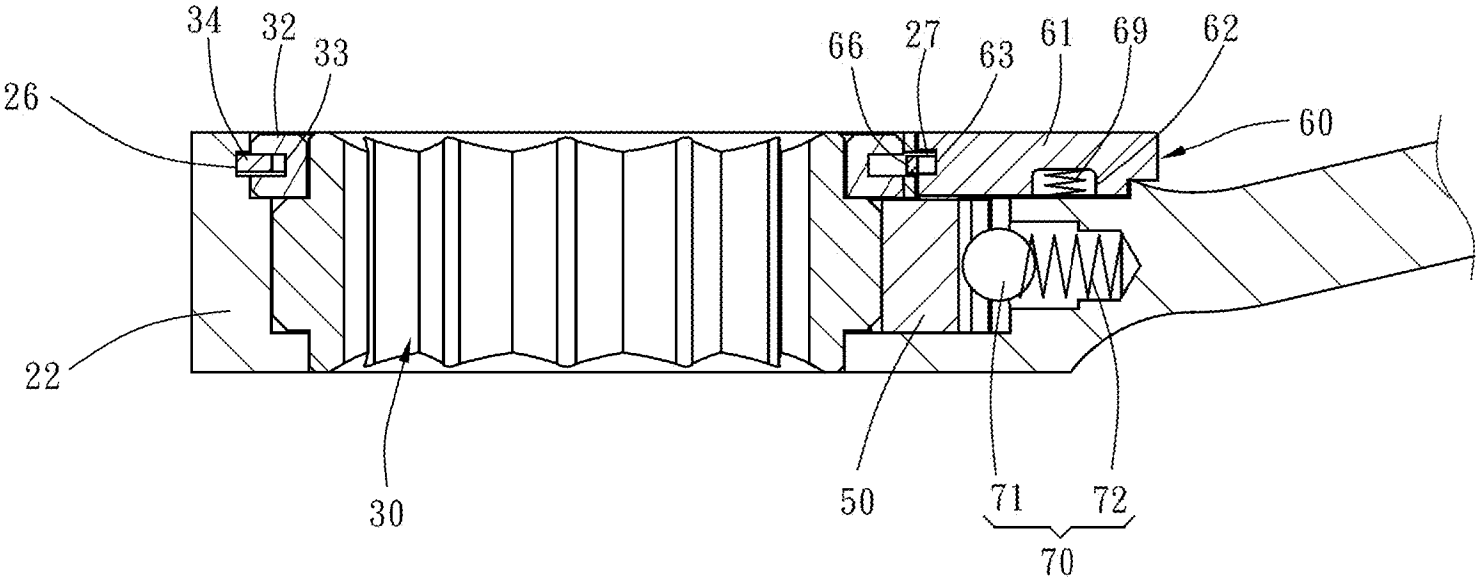
FIG. 3 is a longitudinal sectional view of a part of the two-way ratchet wrench in accordance with the first embodiment of the present invention.

The check device set 40 comprises a ratchet block 50, a dial block 60 and an elastic member 69, as shown in FIGS. 2 and 3.

The ratchet block 50 is mounted in the accommodation chamber 24 of the wrench body 20, comprising a ratchet portion 51 facing toward the ratchet wheel 30 and meshed with the toothed portion 31 of the ratchet wheel 30. and the ratchet block 50 further has a first recess 52 and a second recess 53 located on one side thereof opposite to the ratchet wheel 30.

The dial block 60 comprises a dial block body 61 and a tab 65 connected with the dial block body 61. The dial block body 61 is mounted in the accommodation hole 25 of the wrench body 20, having a bottom groove 62. The tab 65 is disposed outside the accommodation hole 25. The dial block body 61 further comprises a second external annular indentation 63 around a periphery of the dial block body 61. A second C-shaped retainer 66 is mounted between the second internal annular indentation 27 and the second external annular indentation 63, securing the dial block body 61 of the dial block 60 to the accommodation hole 25 of the wrench body 20 in a rotatable manner.

Figure 6:
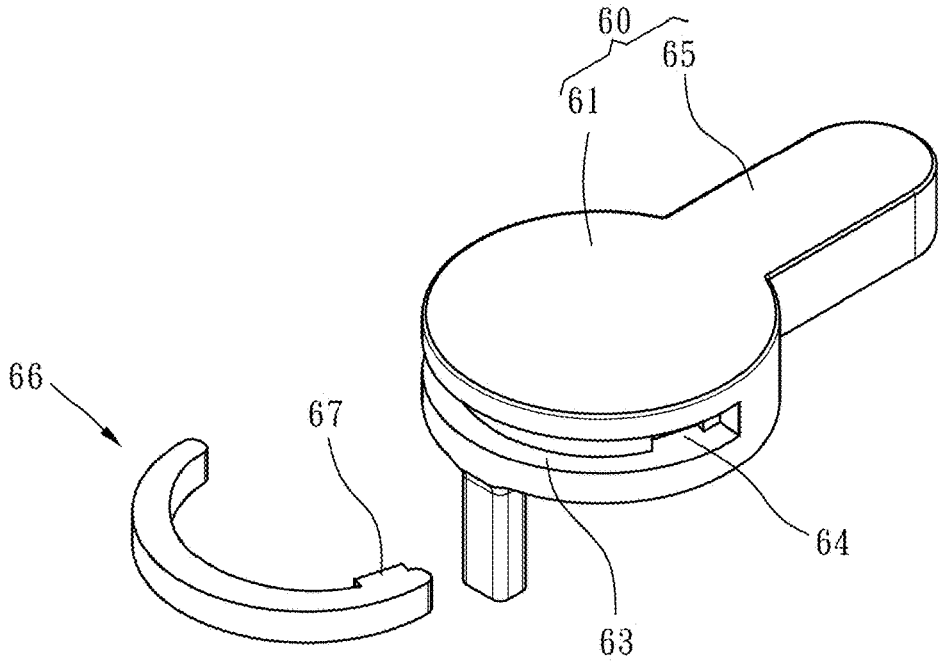
FIG. 6 is an exploded view of a dial block and a second C-shaped retainer of a two-way ratchet wrench in accordance with a second embodiment of the present invention.
Figure 7:
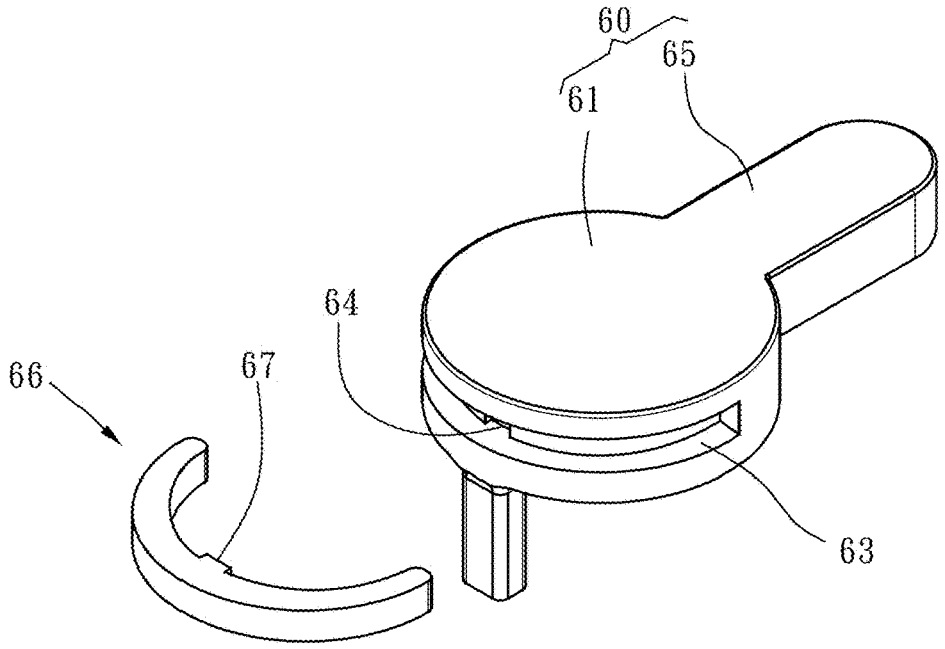
FIG. 7 is an exploded view of a dial block and a second C-shaped retainer of a two-way ratchet wrench in accordance with a third embodiment of the present invention.

Furthermore, in order to increase the convenience of assembly, the wall of the second external annular indentation 63 is configured to provide a plug hole 64. The plug hole 64 may be located at one end of the second external annular indentation 63 (as shown in FIG. 6) or located at a midpoint of the second external annular indentation 63 (as shown in FIG. 7). The second C-shaped retainer 66 is configured to provide a protruding portion 67 at an inner perimeter thereof. By means of plugging the protruding portion 67 into the plug hole 64, the second C-shaped retainer 66 is secured in place. Therefore, the second C-shaped retainer 66 is not easily dropped after having been installed in the second external annular indentation 63. Subject to the elastic restoring energy of the second C-shaped retainer 66 itself, the second C-shaped retainer 66 is engaged between the second internal annular indentation 27 and the second external annular indentation 63.

The ratchet block 50 further comprises a transmission hole 54 cut through opposing top and bottom walls thereof. The transmission hole 54 has a triangular cross section. The dial block 60 further comprises a transmission rod 68 extended from the dial block body 61. The transmission rod 68 has a quadrilateral cross section. Further, the outer diameter of the transmission rod 68 is smaller than the transmission hole 54. The dial block 60 is inserted into the transmission hole 54 of the ratchet block 50 by the transmission rod 68, so that the transmission rod 68 can accurately drive the ratchet block 50 to move between a first position P1 (see FIG. 4) and a second position P2 (see FIG. 5) during rotation of the dial block 60.

The elastic member 69 is mounted in the bottom groove 62 of the dial block 60 and abutted between the dial block body 61 of the dial block 60 and the head 22 of the wrench body 20 to provide a spring force to the dial block 60, reducing friction interference between the dial block body 61 of the dial block 60 and the head 22 of the wrench body 20 and enhancing the operational stability and smoothness of the dial block 60.

Figure 5:
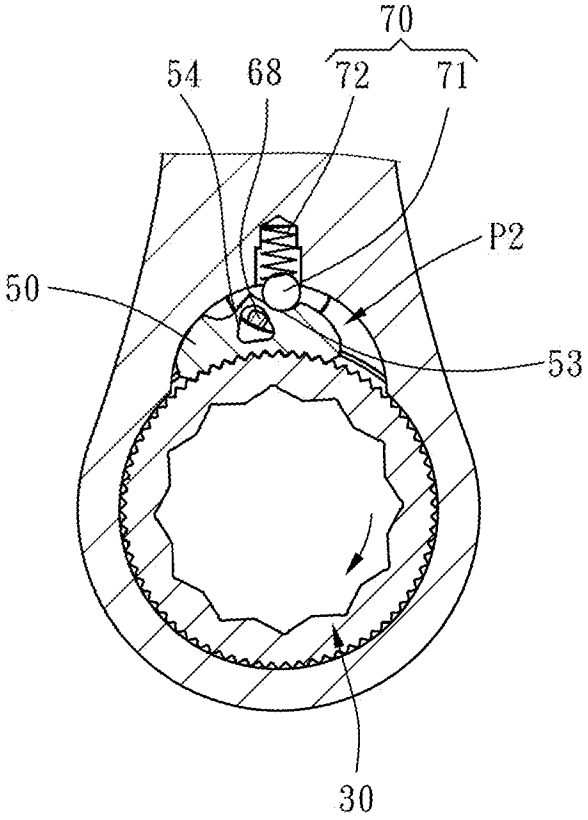
FIG. 5 is similar to FIG. 4, illustrating the ratchet block in the second position.
Figure 4:
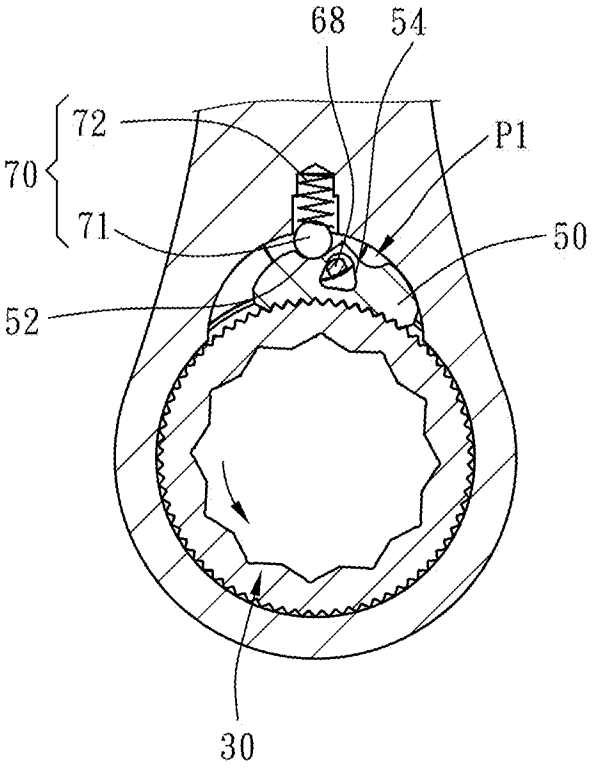
FIG. 4 is a transverse sectional view of the two-way ratchet wrench in accordance with the first embodiment of the present invention, illustrating the ratchet block in the first position.

The positioning device 70 comprises a positioning ball 71, and an elastic member 72 abutted against the positioning ball 71. Thus, the positioning ball 71 is forced by the elastic member 72 to abut against the first recess 52 or the second recess 53 of the ratchet block 50 according to the position of the ratchet block 50, causing the ratchet block 50 to abut the ratchet wheel 30 to control the direction of rotation of the ratchet wheel 30. When the ratchet block 50 is in the first position P1 as shown in FIG. 4, the positioning ball 71 is pressed against the first recess 52 of the ratchet block 50, and the ratchet wheel 30 can only be rotated in the counterclockwise direction. On the contrary, when the ratchet block 50 is in the second position P2 as shown in FIG. 5, the positioning ball 71 is pressed against the second recess 53 of the ratchet block 50, and the ratchet wheel 30 can only be rotated in the clockwise direction.

In conclusion, by means of the structural cooperation between the dial block 60 and the ratchet block 50, the two-way ratchet wrench 10 of the present invention can be operated stably and smoothly and the parts are not easily dropped during assembly, achieving the purpose of increasing operational reliability and assembly convenience.

What is claimed is:

1. A two-way ratchet wrench, comprising a wrench body comprising a head at one end thereof and an open end portion at an opposite end thereof, said head comprising a ratchet groove, an accommodation chamber being radially disposed in communication with said ratchet groove and an accommodation hole being adjacent to said ratchet groove and disposed above said accommodation chamber;

a ratchet wheel rotatably mounted in said ratchet groove of said wrench body, said ratchet wheel comprising a toothed portion around a periphery of said ratchet wheel;

a check device set comprising a ratchet block and a dial block, said ratchet block being mounted in said accommodation chamber of said wrench body and comprising a ratchet portion facing toward said ratchet wheel, and a first recess and a second recess located on one side thereof opposite to said ratchet wheel, said ratchet portion of said ratchet block being meshed with said toothed portion of said ratchet wheel, said dial block being rotatably mounted in said accommodation hole of said wrench body and connected with said ratchet block, said dial block being operable to move said ratchet block between a first position and a second position; and a positioning device being mounted in said accommodation chamber of said wrench body, said positioning device being abutted against said first recess of said ratchet block when said ratchet block is disposed in said first position, said positioning device being abutted against said second recess of said ratchet block when said ratchet block is disposed in said second position;

wherein said dial block comprises a dial block body and a tab connected with said dial block, said dial block body comprises a bottom groove located in a bottom wall thereof; said check device set further comprises an elastic member mounted in said bottom groove and abutted between said dial block body of said dial block and said head of said wrench body;

wherein said wrench body further comprises an internal annular indentation located in a hole wall of said accommodation hole; said dial block further comprises an external annular indentation located on an outer perimeter of said dial block body; said check device set further comprises a C-shaped retainer mounted between said internal annular indentation and said second external annular indentation to secure said dial block to said accommodation hole; and wherein said dial block body further comprises a plug hole located in a wall of said external annular indentation; said C-shaped retainer comprises a protruding portion protruded from an inner perimeter thereof and plugged into said plug hole.

2. The two-way ratchet wrench as claimed in claim 1, wherein said ratchet block further comprises a transmission hole; said dial block further comprises a transmission rod extended from said dial block body and plugged into said transmission hole of said ratchet block; the outer diameter of said transmission rod of said dial block is smaller than said transmission hole of said ratchet block.

3. The two-way ratchet wrench as claimed in claim 2, wherein said transmission rod has a quadrilateral cross section; said transmission hole has a triangular cross section.

4. The two-way ratchet wrench as claimed in claim 1, wherein said positioning device comprises a positioning ball and an elastic member abutted against said positioning ball; said positioning ball is abutted against said first recess of said ratchet block when said ratchet block is in said first position; said positioning ball is abutted against said second recess of said ratchet block when said ratchet block is in said second position.

* * * * *